United States Patent [19]

Brown et al.

[11] Patent Number: 4,652,207

[45] Date of Patent: Mar. 24, 1987

[54] VANELESS CENTRIFUGAL PUMP

[76] Inventors: Charles W. Brown, Rte. 1, Box 111; George Z. Mann, P.O. Box 65, both of Ridge Spring, S.C. 29129

[21] Appl. No.: 822,700

[22] Filed: Jan. 27, 1986

Related U.S. Application Data

[63] Continuation-in-part of Ser. No. 633,286, Jul. 23, 1984, abandoned.

[30] Foreign Application Priority Data

Jul. 22, 1985 [EP] European Pat. Off. ..... 85306644

[51] Int. Cl.[4] ..... F04D 1/00

[52] U.S. Cl. ..... 415/90; 415/215; 416/188

[58] Field of Search ..... 415/90, 213 A, 213 R, 415/215; 416/185, 188

[56] References Cited

U.S. PATENT DOCUMENTS

| | | | |
|---|---|---|---|
| 651,400 | 6/1900 | Truve et al. | 415/126 |
| 1,934,013 | 11/1933 | Sim | 415/213 R UX |
| 2,008,308 | 7/1935 | Jacobsen | 415/213 R |
| 2,392,124 | 1/1946 | Denys | 55/406 |
| 2,569,563 | 10/1951 | Grantham | 415/90 |
| 2,741,992 | 4/1956 | Glazebrook | 415/213 R |
| 2,977,042 | 3/1961 | Jassniker | 415/206 |
| 3,692,422 | 9/1972 | Girardier | 415/213 R X |
| 3,864,055 | 2/1975 | Kletschka et al. | 415/1 |
| 3,957,389 | 5/1976 | Rafferty et al. | 415/1 |
| 3,970,408 | 7/1976 | Rafferty et al. | 415/60 |
| 4,036,584 | 7/1977 | Glass | 415/90 |
| 4,037,984 | 7/1977 | Rafferty et al. | 415/60 |
| 4,239,453 | 12/1980 | Hergt et al. | 415/182 |

FOREIGN PATENT DOCUMENTS

| | | | |
|---|---|---|---|
| 623422 | 7/1961 | Canada | 415/213 R |
| 393092 | 10/1965 | Switzerland | 415/213 A |

*Primary Examiner*—Robert E. Garrett
*Assistant Examiner*—Joseph M. Pitko
*Attorney, Agent, or Firm*—Benoni O. Reynolds

[57] ABSTRACT

A centrifugal pump utilizing laminar action induced by a vaneless impeller and having a minimal drag front plate which cooperates with the circular rotor. The smooth surface of the concave face of the circular rotor has no protrusions or vanes and approximates an Archimedian curve. Material entering the intake port of the front plate is diverted about the rotating circular rotor and redirected in an outwardly direction along the minimal drag interior surface of the front plate to the discharge port of the output housing. The narrowing of the interior surface of the front plate in a radially outward direction with respect to the concave face of the impeller helps the pump to maintain a constant volumetric flow rate. Inasmuch as the "redirecting" of the incoming material stream follows an approximate Archimedian spiral, the pressures applied against the impeller and the forces acting centrifugally on the material stream join to produce the optimum imparting of kinetic energy to the material stream for the particular impeller speed. As a slurries pump, the vaneless design permits any particulate size that can clear the discharge port of the pump to safely transit through the pump without maceration or undue agitation. As cavitation is totally absent, the pump can easily handle the movement of fragile, volatile or gaseous materials and can be operated over a wide range of speeds, matching desired feed without undue loss of efficiency. Lacking vanes, the impeller offers very low starting torque under a loaded condition.

1 Claim, 3 Drawing Figures

VANELESS CENTRIFUGAL PUMP

This application is a continuation-in-part of previous application, Ser. No. 633,286, filed July 23, 1984, now copending (automatically abandoned).

BACKGROUND OF THE INVENTION (1) Field of Invention

This invention relates to centrifugal pumps for moving fluids or slurries of varying viscosities. In particular, it relates to such pumps having impellers which by laminar action or friction induced movement to the contained medium in the similar manner that movement of a fluid through a stationary pipe is restricted by the friction of the pipe.

(2) Description of the Prior Art

Most impellers for centrifugal pumps have some type of vane to impart movement to the contained fluid or slurry through the pump. These vane-type impellers have limited life because of the problem of cavitation which is the gradual deterioration or erosion of the surfaces of the vanes over time due to the movement of the materials in and around the vanes, creating pockets of vapor which explode causing damage. In addition, the typical vane-type impeller offers a very high starting torque under loaded conditions. Also, many pumps designed for the movement of high viscosity slurries are limited as to the particulate size that can be safely transited through the pump without unduly eroding the pump parts. Because of these problems, most pump parts must be manufactured of highly durable, and therefore expensive, materials. Also such pumps relatively high operating costs. The impeller of the instant invention has no such material two conoidal shells rectilinear generatrixes which may be convergent, divergent or curvilinear and connected by rectlinear or helical ribs. There were a number of attempts in later years to improve the efficiency of impellers. Denys, in 1946, designed a disc of concave-convex profile, a disc of uniform strength, in which the stress at any point between the center and the rim was constant. His operating principle was that lighter molecular weight gases impinge more frequently on the rotating disk from left to right. The tangential component of rotation propels heavier molecules towards the outer periphery from where they are scavenged; lighter gas molecules are scavenged from the central outlet. Later Grantham (1951) developed a centrifugal pump in which the impeller (frusto-conical) had a conical liquid-engaging surface with spiral grooves cut therein. Pumping space was adjustable to vary the volume of liquid pumped. A modification of the invention had a multi-cone impeller.

Perhaps the closest prior art to the present invention is found in the pumps of Kletschka et al. (1975) which were capable of use as heart pumps and blood pumps. Circular fluid rotators (accelerators) were outwardly convergent and rotated to impel the fluid circularly at substantially the speed of the rotators. Angular velocity of the rotator increased as the radial distance from the axis increased. The pumping action was radially increasing pressure gradient pumping or more specifically, it was constrained force-vortex radially increasing pressure gradient pumping. The rotators were of hollow frusto-conical form, convergent at the peripherals. These same inventors designed similar devices, apparently with the primary objective of developing apparatus for use with delicate fluids.

Less specific prior art is found in the "turbine" of Glass (1977) which is a multi-disk plate turbine reminiscent of Tesla. The turbine had tangential nozzle delivery to peripheral portions of the plates to impart motion. Discharge was through the center. Spiral like fencing was found between adjacent plates.

Recent tangential art known to these inventors is the patent of Hergt et al (1980) which pump was designed for reducing cavitation-induced erosion of centrifugal pumps. A conical or stepped intake diffuser directs flow of part-load eddy from impeller back into intake fluid pulse flow. Downstream portion of the diffuser constitutes an integral part of the impeller. The present invention is designed to overcome the drawbacks of prior art impellers that are subject to cavitation and to solve other problems associated with centrifugal pumps designed primarily for pumping slurries.

Prior art known to these inventors includes the following U.S. Pat. Nos.:

| | | |
|---|---|---|
| 651,400 | 6/1900 | Trouve & Bellot |
| 2,392,124 | 1/1946 | Denys |
| 2,569,563 | 10/1951 | Grantham |
| 2,977,042 | 3/1961 | Jassniker |
| 3,864,055 | 2/1975 | Kletschka et al. |
| 3,957,389 | 5/1976 | Rafferty et al. |
| 3,970,408 | 7/1976 | Rafferty et al. |
| 4,036,584 | 7/1977 | Glass |
| 4,037,984 | 7/1977 | Rafferty et al. |
| 4,239,453 | 12/1980 | Hergt et al. |

BRIEF SUMMARY OF THE INVENTION

The present invention is a Vaneless Centrifugal Pump designed to overcome cavitation and the maceration found in conventional centrifugal pumps by utilizing design principles derived from aerodynamics. The impeller means of the present invention is a circular rotor having a concave face configured, in accordance with the principles of the present invention, from the center of the circular rotor to the outer perimeter of the circular rotor, to approximate an Archimedian curve, as shown in the accompanying drawings. The surface of the circular rotor is very smooth. The circular rotor is fastened to a shaft which is supported by a back plate means. The back plate means is a backplate configured to support the circular rotor and has a profile conforming to the profile of the rear surface of the circular rotor, permitting the circular rotor to nestle inside the backplate yet providing the necessary clearance between the circular rotor and the back plate. The backplate has an opening to receive the shaft mounted therethrough and to support the sealing housing containing the seal which surrounds the shaft. The back plate is coupled to a power frame or to an electric motor by means of an interconnecting frame adapter. Beyond the frame adapter the shaft is mechanically connected to a driving motor, not shown in the accompanying drawings, because suitable driving motors are well known in the art.

A front plate means is provided which, in conjunction with back plate means and impeller means, forms a pumping chamber. Front plate means and back plate means are attached together by mounting flanges, capscrews and nuts, proving a water tight seal. Front plate means is a front plate having input port, output housing and discharge port, which front plate has a smooth interior surface configured, as shown in the accompanying drawings, to present minimal drag to the movement of materials pumped therethrough. Output housing junctures with the front plate at the discharge port and the upper end of the output housing connects to an output distribution system not shown in the accompanying drawings. The interior surface of the front plate contributes to the efficiency of the Vaneless Centrifugal Pump by the configuration of the interior surface, in accordance with the principles of the present invention, to present minimal drag to the movement of materials, such as fluids and slurries, passing by the interior surface on the way through the pumping chamber to the discharge port during the pumping operation.

The shape of the circular rotor is such as to provide a concave annular surface the curvature of which gradually decreases as seen in radial section going outwardly from the center. This is because the centrifugal force on the inflowing material increases towards the periphery. The front plate is carefully shaped relative to the profile of the circular rotor. The axial space between the front plate and the circular rotor decreases outwardly so that the effective cross-section is substantially constant from the input port to the discharge port of the front plate. More precisely, the vaneless centrifugal pump provides for a constant volumetric flow right through the pump.

Material entering the intake port of the front plate is diverted about the rotating impeller and redirected in an outwardly direction along the minimal drag interior surface of the front plate to the discharge port and the adjacent output housing. As the "redirecting" of the incoming material stream follows an approximate Archimedian spiral, the pressure applied against the impeller (resulting in laminar action) and the forces acting centrifugally on the material stream, join to produce the optimum imparting of kinetic energy to the material stream for the particular impeller speed. The incoming material stream follows an approximate Archimedian spiral, as seen axially of the fixed front plate, due to the fact that laminar flow is induced within the pumping chamber with substantially no cavitation whatsoever.

As a slurries pump, the vaneless design permits any particulate size of material which can clear the discharge port of the pump to safely transit the pump without maceration or undue agitation. As cavitation is totally absent, the pump can easily handle the movement of fragile, volatile or gaseous materials. Lacking cavitation, the pump can be operated over a wide range of speeds, matching desired feed without undue loss of efficiency. Lacking vanes, the impeller offers very low starting torque under a loaded condition and thus obvious savings in operating and maintenance costs. The variable delivery of the pump and its ability to handle slurries of various densities, without cavitation, presents a significant advance in the art.

OBJECTIVES OF THE INVENTION

The objectives of the present invention are to provide a vaneless centrifugal pump for pumping fluids or slurries which is (1) not subject to the cavitation or agitation found in conventional centrifugal pumps;

(2) more simple and inexpensive to manfacture than pumps known in the prior art designed to perform the same function;

(3) compact in size and unitary in design to permit less costly installation and maintenance;

(4) more efficient to operate, presenting lower starting torque under loaded conditions.

Other objectives and advantages of the present invention will be apparent during the course of the following detailed description.

DETAILED DESCRIPTION OF THE PREFERRED EMBODIMENT OF THE INVENTION

Figure 1:
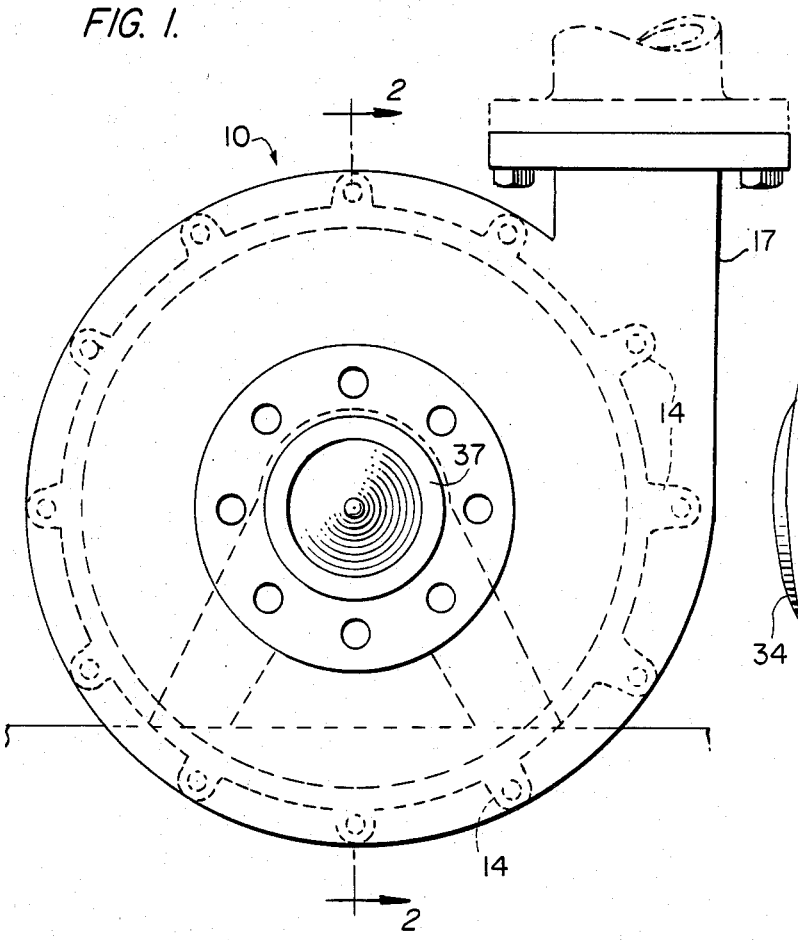
FIG. 1 is a perspective view from the front of a Vaneless Centrifugal Pump, constructed in accordance with the principles of the present invention, showing the front plate means and the output housing.
Figure 3:
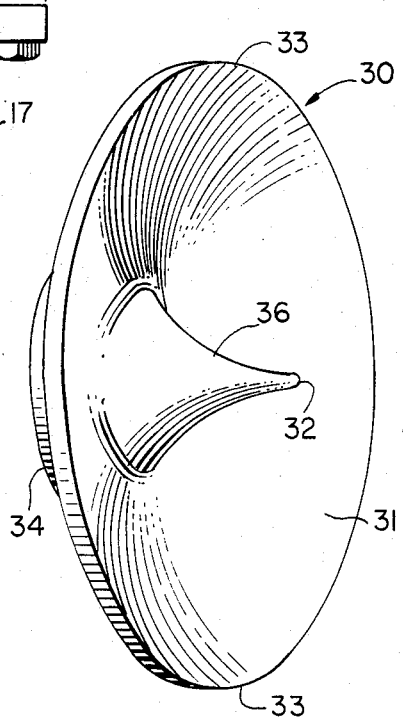
FIG. 3 is a perspective view from the left front of the impeller, constructed in accordance with the principles of the present invention, showing the concave face of the impeller which concave face is configured from its center to its outer perimeter to approximate an Archimedian curve.
Figure 2:
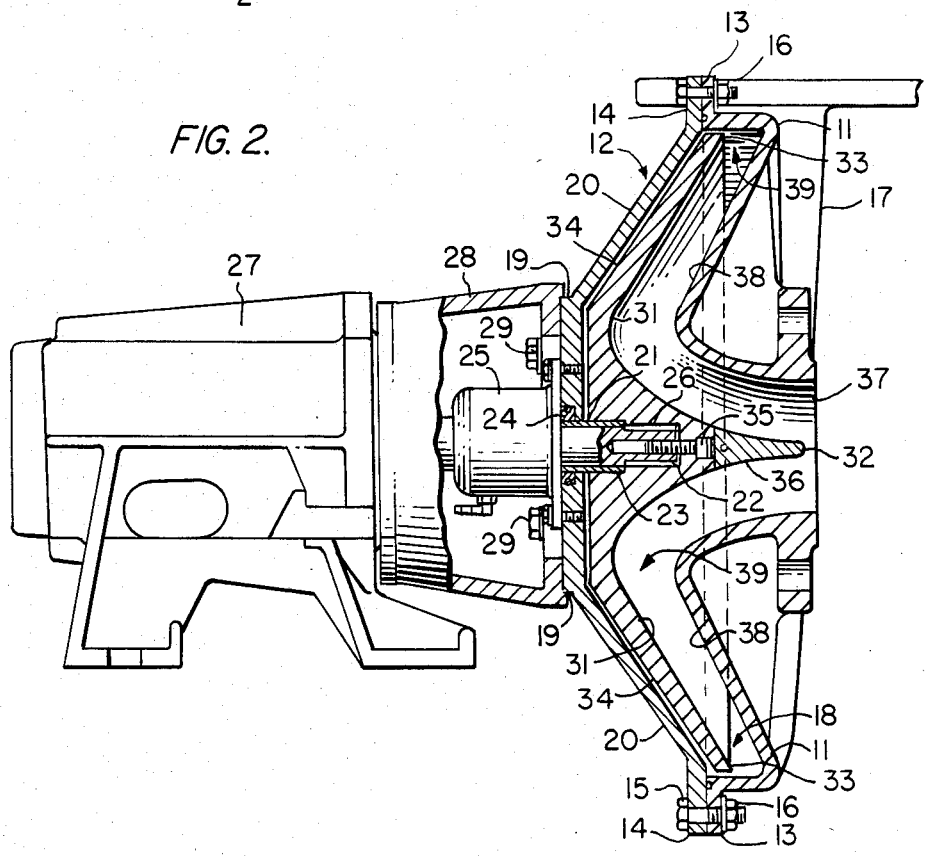
FIG. 2 is a fragmentary side sectional view of the Vaneless Centrifugal Pump of the present invention, taken along line 2—2 of FIG. 1, looking in the direction of the arrows, showing the front plate means, the back plate means, impeller means and the design of the pumping chamber formed by the concave face of the impeller means and the interior surface of the front plate means.

The Vaneless Centrifugal Pump is a compact, relatively small unit, which is easily and quickly installed at a site where the pumping of or slurries is desired. Throughout the following detailed description of the present invention like reference numerals are used to denote like parts disclosed in the accompanying drawings, FIGS. 1–3. As shown in FIGS. 1, 2 and 3, the Vaneless Centrifugal Pump has a circular shaped housing, indicated generally at reference numeral 10, composed of front plate means 11 and back plate means, indicated generally by reference numeral 12, which are held together by mounting flange 13 along the outer perimeter of front plate means 11 and mounting flange 14 about the outer perimeter of back plate means 12. Mounting flange 13 and mounting flange 14 are secured to one another by cap screws 15 and nuts 16. Optionally, mounting flange 13 and mounting flange 14 could be secured to one another by cap screws 15 and retaining threads (not shown) tapped into either of said mounting flanges. Extending upwardly from the right side of front plate means 11, as an integral part thereof, is output housing 17 which in turn fastens at its upper end to an output distribution system, not shown. Output housing 17 communicates with front plate means 11 through discharge port, indicated generally by reference numeral 18, located at the juncture of front plate means 11 and output housing 17.

Back plate means 12 is a backplate for mounting the circular rotor of impeller means 30 thereon and has a profile conforming to the profile of the rear surface of the circular rotor of impeller means 30. Backplate means 12 has a vertical center portion 19 and extension portion 20 which flares inwardly, at approximately 35 degrees to the vertical, to join front plate means 11 at mounting flange 13 and mounting flange 14. At the center of back plate means 12, an opening 21 is provided to receive shaft 22 and shaft sleeve 23. Shaft sleeve 23 is surrounded by seal 24 which is held in place and kept moist by seal housing 25, thus providing a waterproof juncture. Shaft 22 is secured to impeller means 30 by key 26.

Back plate means 12 is connected to power frame 27 by frame adapter 28 which bolts to center portion 19 of back plate means 12 by a plurality of mounting cap screws 29 spaced and tapped at equal intervals around the periphery of center portion 19 of back plate means 12. Shaft 22 is mechanically connected to a suitable driving motor, not shown.

Impeller means, indicated generally by reference numeral 30, is a circular rotor to impart laminar movement to materials being pumped thereby and is configured to approximate an Archimedian curve. Impeller means 30 has a concave face 31 whose smooth surface is configured, from center 32 to outer perimeter 33, to approximate an Archimedian curve as shown in FIGS. 2 and 3. Rear surface 34 of impeller means 30 is shaped to conform to the dimensions of, and the enclosure formed by, center portion 19 and extension portion 20 of back plate means 12. Impeller means 30 is fastened to shaft 22 by capscrew 35, threaded into the end of shaft 22 and by key 26. Nose piece 36 is threaded or snapped onto center 32 of impeller means 30 to cover the attachment means just described and to preserve the Archimedian curve of concave face 31.

The front plate of front plate means 11, in conjunction with the backplate of backplate means 12 and the circular rotor of impeller means 30, forms a pumping chamber 39. Front plate means 11 is a front plate having input port 37, output housing 17 and discharge port 18, which front plate has interior surface 38 configured to present minimal drag to the movement of materials pumped therethrough. Front plate means 11 has input port 37, to access concave face 31 of impeller means 30, designed and positioned to direct the incoming fluids or slurries, in and around center 32 of impeller means 30, striking the smooth surface of concave face 31 as impeller means 30 rotates, inducing the laminar action effect observed in the art in stationary conduits. The combined forces, from the friction effect of rotating impeller means 30 and the centrifugal action of the moving material, accelerates the material rapidly, but smoothly, to discharge port 18 of output housing 17 and thence on into the output distribution system, not shown. Interior surface 38 of front plate means 11 is configured, in cooperation with the Archimedian curve of impeller means 30, to present minimal pressure, and thus minimal drag, to the movement of the fluid or slurry as these materials move through pumping chamber, shown generally by reference numeral 39, to discharge port 18. Interior surface 38 presents this minimal drag by narrowing in a radially outward direction with respect to concave face 31 of the circular rotor, to maintain the volume, and thus constant pressure, of the inflowing materials, and by directing the movement of the inflowing material in a streamline, the chord of which streamline is parallel to the chord of the Archimedian spiral described by the inflowing material on the circular rotor.

As best illustrated by FIG. 2, the material stream to be pumped enters the pump of the present invention through input port 37 where the stream strikes concave face 31 of impeller means 30 at approximately a right angle to the plane of impeller means 30. As impeller means 30 rotates, the material stream is redirected by the friction effect of spinning impeller means 30 outwardly towards the outer perimeter of impeller means 30 setting up laminar action along concave face 31 and increasing the angular velocity of the stream as it is diverted to the outer perimeter of impeller means 30 through pumping chamber 39 to discharge port 18. Interior surface 38 of front plate means 11 is configured to present minimal pressure, and thus minimal drag, to the material stream as it is redirected by impeller means 30. The combination of the design of concave face 31 (Archimedian curve) of impeller means 30 and the minimal pressure, minimal drag configuration of interior surface 38 of front plate means 11, together provide an environment in which laminar flow is set up, contrary to the situation in known pumps. Such non-turbulent fluid flow with a low Reynolds number is found to provide an optimum efficient environment for pumping materials of nearly all types, including slurries which have high viscosities. The absence of the usual gaseous bubbles generated by vane-type centrifugal pumps, overcomes the problem of cavitation which is the gradual deterioration of the vanes, usually accompanied by a rattling noise and vibration of the pumping mechanisms. The absence of the vanes also permits the pumping of material of any particulate size, without maceration or undue agitation, which will clear discharge port 18 of the Vaneless Centrifugal Pump of the present invention. The absence of cavitation also permits the use of less expensive materials for casting impeller means 30, such as plastic, whereas vane-type impellers are normally constructed of highly durable metals to combat cavitation. Of course, vane-type impellers are by design more complicated and thus more expensive to manufacture than impeller means 30 of the present invention. Being more complicated, centrifugal pumps having vane-type impellers are necessarily more expensive to manufacture and more difficult to balance than the Vaneless Centrifugal Pump of the present invention.

Impeller means 30, by its configuration having a reverse surface plane greater than 90 degrees to the horizontal axis of the inflowing material, automatically is exercising boundary layer control similar to that observed in aerodynamics. The shape of impeller means 30 controls the pressure by establishing a predetermined path for the material being pumped. The control is automatic because the pumped material follows the point of least pressure across concave face 31 which is the path of least resistance. Graphically the material is describing a streamline in the shape of an Archimedian spiral across concave face 31 as impeller means 30 rotates, said streamline being similar to the upper surface of an aircraft wing.

The curvature of interior surface 38 of front plate means 11 is designed to complement and not to interfere with the laminar induced movement of the material as it heads for discharge port 18. Trial and error observations during development by these inventors has established minimal drag to be evident when the chord of the Archimedian spiral described on impeller means 30 is exactly parallel with the chord of the streamline described by the movement of the pumped material along interior surface 38 of front plate means 11 between reference point 37 (input port) and point 11, where front plate means 11 joins back plate means 12. This minimal drag appears to be achieved when pumping chamber 39 provides for a constant volumetric rate of flow through the vaneless centrifugal pump, and interior surface 38 of front plate means 11 is shaped so as to produce this effect. It should also be noted that the cross-sectional areas of input port 37 and discharge port 18 will be the same as each other and as the effective annualar cross-section through pumping chamber 39. The precise shape of discharge port 18 may not be that important provided it is smooth and does not upset the laminar flow through the vaneless centrifugal pump.

The efficient design of the present invention reduces operating costs by requiring less torque to start the driving motors under load conditions. Also there are no vanes to clog or present obstructions to the free flow of the material being pumped, thus minimizing wear and tear on the pump and reducing maintenance costs. Although the Archimedian curve shown in the accompanying drawings is the preferred embodiment, these inventors claim a circular rotor, to impart laminar movement to materials being pumped thereby, having a concave face 31, configured to approximate an Archimedian curve ranging at an angle from 91 degrees to 135 degrees in relation to the horizontal axis of the inflowing materials pumped therethrough.

The manufacture of impellers and centrifugal pumps is well known in the art. The variables are the viscosity and specific gravity of the material being pumped, the RPM (revolutions per minute) of the pump motor, and the temperature of the pumped material. Impellers can be molded or turned on a lathe as was done in fabricating the instant invention. The preferred embodiment of the Vaneless Centrifugal Pump of the present invention, shown in the drawings, could be manufactured by merely templating the curvatures of the impeller means 30, the front plate means 11 and the back plate means 12, as shown, or as would show on a proportional enlargement of the drawings.

PAPER EXAMPLE 1

With the valve of the present invention wide open there would be 29.2 feet of head=131.5 gallons per minute at 3551 RPM. The pump is a 2×3 pump (2 inch discharge and 3 inch suction line). Closing the valve results in 0 gallons per minute=71.4 feet of head at 3556 RPM with a motor rating of 3750 RPM. As the valve of the present invention was closed the head pressure increased from 29.2 feet to 71.4 feet with no observed drop in RPM. In fact, there was a slight increase in RPM. Normally a test such as this would stall a pump or motor. The present invention justs slips under this closedvalve condition.

PAPER EXAMPLE 2

Assume delivery requirement of 50 feet of head and 100 gallons per minute with 3" by 4" plumbing. Pick an off-the-shelf pump with 1800 r.p.m. and 7½ HP. With a conventional pump designed to operate at a constant speed and a constant delivery, if you varied the speed to vary the delivery, you would get cavitation and rapidly erode the pump parts. The present invention avoids this problem by sizing the pump to use a 3" by 4" impeller. To vary the delivery from 1 gallon to 5000 gallons per minute, we need only to vary the RPM from 500 to 3500, getting a head varying from 0 to 150 feet. The entering material finds it natural inflow path along the points of minimal pressure on concave face 31. The user can vary the speed to alter the delivery with no adverse effects on the pump.

Other pumps depend on paddles or vanes to move fluids, not on the surface of the impeller, which is at a neutral angle of 90 degrees to the horizontal on most pumps. The present invention relies entirely on the concave face 31 of the impeller means 30 to impart movement to the pumped material, so the propelling agent is different than in prior art pumps. The present invention has one design for one delivery, varying in size only to fit different diameters of input. The reverse plane of concave face 31 produces the laminar action describing an Archimedian spiral as the particles of pumped material pass from the center to the outer edge of the revolving concave face 31.

We claim:

1. A vaneless centrifugal pump, in combination with a driving motor, which comprises:

a circular rotor, to impart laminar movement to materials being pumped thereby, having a concave face configured to aproximate an Archimedian curve, ranging at an angle from 91 degrees to 135 degrees in relation to the horizontal axis of the inflowing materials pumped therethrough, and a backplate, for mounting said circular rotor thereon, having a profile conforming to the profile of the rear surface of said circular rotor, and a front plate, in conjunction with said backplate and said circular rotor forming a pumping chamber, said front plate having input port, output housing and discharge port, which front plate has an interior surface configured to present minimal drag by narrowing in a radially outward direction with respect to said concave face of said circular rotor, to maintain the volume, and thus constant pressure, of said inflowing materials, and directing the movement of said inflowing material in a streamline, the chord of which streamline is parallel to the chord of the Archimedian spiral described by said inflowing material on said circular rotor.

* * * * *